US009677260B2

(12) United States Patent
Miyake et al.

(10) Patent No.: US 9,677,260 B2
(45) Date of Patent: Jun. 13, 2017

(54) FLUSH TOILET

(71) Applicant: TOTO LTD., Kitakyushu-shi, Fukuoka (JP)

(72) Inventors: Tsubasa Miyake, Kitakyushu (JP); Jing Chen, Kitakyushu (JP); Haruhiko Fukumoto, Kitakyushu (JP); Nobuhiro Motohashi, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/074,723

(22) Filed: Mar. 18, 2016

(65) Prior Publication Data

US 2016/0281343 A1 Sep. 29, 2016

(30) Foreign Application Priority Data

Mar. 24, 2015 (JP) ..... 2015-060981
Mar. 24, 2015 (JP) ..... 2015-060982

(51) Int. Cl.

| | |
|---|---|
| ***E03D 1/34*** | (2006.01) |
| ***E03D 5/01*** | (2006.01) |
| ***E03D 5/10*** | (2006.01) |
| ***E03D 1/36*** | (2006.01) |

(52) U.S. Cl.

CPC ..... *E03D 5/01* (2013.01); *E03D 1/36* (2013.01); *E03D 5/10* (2013.01); *E03D 2201/30* (2013.01)

(58) Field of Classification Search

CPC ..... E03D 5/01; E03D 5/10
USPC ..... 4/378, 432
See application file for complete search history.

(56) References Cited

U.S. PATENT DOCUMENTS

| | | | | |
|---|---|---|---|---|
| 4,776,631 | A * | 10/1988 | Sargent | B60R 15/04 141/95 |
| 2008/0216905 | A1* | 9/2008 | Dorsey | E03D 5/01 137/565.11 |
| 2009/0313750 | A1* | 12/2009 | Okubo | E03D 5/01 4/354 |
| 2016/0273205 | A1* | 9/2016 | Kashirajima | E03D 1/00 |

* cited by examiner

*Primary Examiner* — Huyen Le
(74) *Attorney, Agent, or Firm* — Brooks Kushman P.C.

(57) ABSTRACT

A flush toilet includes a valve apparatus for spouting and stopping water to a storage tank or a toilet main unit supplied from a water supply source, and includes a pressurizing pump, being a reversely rotatable pump including a suctioning portion connected to the storage tank, a rim-side discharge portion connected to the toilet main unit rim spouting portion, a jet-side discharge portion connected to the toilet main unit jet spouting portion, and an impeller; and when the impeller is rotating in one direction, the pressurizing pump spouts flush water in the storage tank to the rim-side discharge portion, whereas when the impeller rotates in the other direction, the pressurizing pump spouts flush water in the storage tank to the jet-side discharge portion, or spouts flush water in the storage tank to both the rim-side discharge portion and the jet-side discharge portion.

14 Claims, 5 Drawing Sheets

FLUSH TOILET

CROSS-REFERENCE TO RELATED APPLICATIONS

This application claims priority to JP application JP 2015-060981 filed on, Mar. 24, 2015, and JP application JP 2015-060982 filed on, Mar. 24, 2015 the disclosure of which are incorporated in their entirety by reference herein.

FIELD OF INVENTION

The present invention relates to a flush toilet, and more particularly to a flush toilet flushed by pressurized flush water.

DESCRIPTION OF RELATED ART

For some time, flush toilets flushed by pressurized flush water have included those including a pump disposed in a storage tank for storing toilet flush water and individual discharge pipes for discharging flush water respectively to flush rim spout portions and jet spout portions of the bowl portion from this pump, as set forth, for example, in Patent Document 1 (Japanese Patent Unexamined Publication No. 06-264482 (Heisei)).

In conventional flush toilets of the type set forth in Patent Document 1, a valve apparatus such as a solenoid diaphragm valve or the like is provided along the discharge pipe on the downstream side of the pump in order to achieve spouting from one of either a rim spout portion or a jet spout portion, or simultaneous spouting from both a rim spout portion and a jet spout portion.

Another type of known conventional flush toilet flushed by pressurized flush water is that in which, as set forth in Patent Document 2 (Japanese Patent Unexamined Publication No. 2010-156201), rim spout water is directly supplied from a rim spout port using water main water supplied from a supply source, while flush water stored in a storage tank is pressurized by a pump and this pressurized flush water is ejected from a jet spout port to flush a toilet.

In such conventional flush toilets set forth in Patent Document 2, flush water is first spouted from a rim spout port (front rim flush), then after completion of this spouting from a rim spout port, flush water is spouted from a jet spout port, then after completion of this spouting from a jet spout port, flush water is again spouted from the rim spout port (rear rim flush).

SUMMARY

However, in the above-described conventional flush toilet of Patent Document 1 type, because spouting to the jet spout portion requires a particularly large amount of water, a valve apparatus such as a solenoid diaphragm valve or the like disposed along the discharge pipe on the pump downstream side requires that the flow path cross sectional surface area of the valve apparatus be widened to secure a sufficient quantity of spout water per unit time, which is responsible for flushing performance. Hence increases in the size of the valve apparatus itself cannot be avoided, and because of the increases in product cost associated with installing a valve apparatus and with the number of assembly man hours, a reduction in these is sought.

A further problem is that while in the above-described Patent Document 2 conventional flush toilet water can be spouted from the jet spout only by pressurizing storage tank flush water with a pump, water cannot be spouted from a rim spout port alone, nor can water be spouted from both a rim spout port and a jet spout port, therefore if the fluid pressure of flush water supplied from a water supply source is in a low water pressure range (e.g., <0.05 MPa), it is especially difficult for spout water to be stably sprouted from a rim spout port.

The present invention was therefore undertaken to resolve the above-described pre-existing needs and problems with the conventional art, and has the object of providing a flush toilet capable of reducing the size of the flush toilet as a whole, and of performing stable spouting of water, even in a low fluid pressure supply environment.

In order to resolve the above-described problems, the present invention is a flush toilet comprising: a toilet main unit including a bowl portion, a rim spout portion and a jet spout portion for spouting flush water, and a discharge trap conduit; a storage tank for storing flush water; a valve apparatus for spouting flush water supplied from a water supply source to the storage tank or the toilet main unit; a pressurizing pump including a suction portion connected to the storage tank, a rim-side discharge portion connected to the rim spout portion, and a jet-side discharge portion connected to a jet spout portion; and a control device which executes a rim flush wherein flush water in the storage tank is spouted from the rim spout portion by controlling the pressurizing pump, and/or executes a jet flush wherein flush water is spouted from the jet spout portion by controlling the pressurizing pump; wherein the pressurizing pump is a reversible rotation pump including a reversible rotary impeller, wherein when the impeller is rotating in one direction, flush water in the storage tank is spouted to the rim-side discharge portion, and when the impeller is rotating in the other direction, flush water in the storage tank is spouted to the jet-side discharge portion, or flush water in the storage tank is spouted to both the rim-side discharge portion and the jet-side discharge portion.

According to the invention thus constituted, because the pressurizing pump is the reversible pump including the reversible rotary impeller, when the impeller is rotating in one direction the impeller can spout flush water in the storage tank to the pressurizing pump rim-side discharge portion to execute a rim flush by spouting from the rim spout portion of the toilet main unit.

On the other hand when the impeller is rotating in the other direction, flush water in the storage tank can be spouted to the jet-side discharge portion on the pressurizing pump side so that water can be spouted from the jet spout portion of the toilet main unit, or flush water in the storage tank can be spouted to both the rim-side discharge portion and the jet-side discharge portion, so that water is spouted respectively from the rim spout portion and the jet spout portion of the toilet main unit to execute both a rim flush and a jet flush.

Hence even when flush water supplied from the water supply source is in a low pressure range (e.g. <0.05 MPa), water can be stably spouted by spouting with a pressurizing pump. Also, because a reversible pump including a reversible impeller capable of rotating in one direction and another direction is used as the pressurizing pump, rim spouting and jet spouting can be easily performed by spouting with only a pressurizing pump.

In addition, there is no need to use a device other than the pressurizing pump for adjusting the flow rate of flush water supplied from the storage tank to the rim spout portion and the jet spout portion of the toilet main unit, and because the required occupied space for such equipment other than the pressurizing pump can be eliminated, the overall flush toilet can be reduced in size.

In the present invention, preferably, the control device controls the pressurizing pump so that in a first sequence a predetermined amount of flush water is spouted to the rim spout portion, then in a second sequence a predetermined amount of flush water is spouted to both the rim spout portion and the jet spout portion, and then in a third sequence a predetermined amount of flush water is spouted to the rim spout portion.

According to the invention thus constituted, a series of spouting controls from a first sequence to a third sequence can be easily executed by controlling the pressurizing pump with a control device.

In particular, because a predetermined amount of flush water can be spouted to both a rim spout portion and a jet spout portion in a second sequence, the persistence of the siphon effect in flushing the toilet main unit can be increased.

In the present invention, preferably, the control device controls the pressurizing pump and the valve apparatus so that in a first sequence a predetermined amount of flush water is spouted to the rim spout portion by controlling the pressurizing pump, then in a second sequence a predetermined amount of flush water is spouted to the jet spout portion by controlling the pressurizing pump, and then in a third sequence a predetermined amount of flush water is spouted to the rim spout portion by controlling the valve apparatus.

According to the invention thus constituted, the control device, by controlling the pressurizing pump in such a way that after a predetermined amount of flush water is spouted to the rim spout portion in a first sequence, a predetermined amount of flush water is spouted to the jet spout portion in a second sequence, then controlling the valve apparatus so that a predetermined amount of flush water is spouted to the rim spout portion in the third sequence, is able to save water, particularly compared to controlling the pressurizing pump in the second sequence so as to simultaneously spout a predetermined amount of flush water to both the rim spout portion and the jet spout portion.

In the present invention, preferably, the valve apparatus includes a first valve apparatus for spouting flush water supplied from the water supply source to the storage tank, and a second valve apparatus for spouting flush water supplied from the water supply source to the rim spout portion such that flush water does not pass through the storage tank or the pressurizing pump.

According to the invention thus constituted, because the valve apparatus for spouting and stopping flush water supplied from a supply source to a storage tank or a toilet main unit includes a first valve apparatus for spouting and stopping flush water supplied from a supply source to the storage tank and causing the water to pass through a pressurizing pump to be spouted at a rim spouting portion, and a second valve apparatus for spouting flush water supplied from a supply source at the rim spouting portion without going through a pressurizing pump, flush water supplied from the supply source can be directly spouted at the toilet main unit rim spout portion with the second valve apparatus in an open state.

Therefore by respectively opening a first valve apparatus and a second valve apparatus, water can easily be simultaneously spouted from a toilet main unit rim spout portion and jet spout portion, respectively.

In the present invention, preferably, the control device executes water spouting from the rim spout portion for a predetermined time by opening the second valve apparatus in the second sequence.

According to the invention thus constituted, the execution by the control device of spouting by the rim spout portion for a predetermined time by opening the valve on the second valve apparatus enables the easy simultaneous spouting from the toilet main unit rim spout portion and the jet spout portion.

The present invention preferably further comprises an inflow prevention apparatus that prevents flush water spouted from the rim-side discharge portion of the pressurizing pump or from the second valve apparatus, from flowing into portions other than the rim spout portion.

According to the invention thus constituted, because of the presence of an inflow prevention apparatus for preventing the inflow of flush water spouted from the pressurizing pump rim-side discharge portion or the second valve apparatus to any portion other than the rim spout portion of the toilet main unit, the state in which the pressurizing pump rim-side discharge portion and the second valve apparatus directly communicate (known as "cross connection") can be prevented, therefore the occurrence of water waste wherein flush water spouted from the pressurizing pump rim-side portion or the second valve apparatus flows into any portion other than the toilet main unit rim spout portion can be constrained. The reverse flow and penetration of waste water to the pressurizing pump rim-side discharge portion and the second valve apparatus, respectively, can also be constrained.

The present invention preferably further comprises a first flow path connecting the rim-side discharge portion of the pressurizing pump and the inflow prevention apparatus, a second flow path connecting the second valve apparatus and the inflow prevention apparatus, and a third flow path connecting the rim spout port and the inflow prevention apparatus; wherein the inflow prevention apparatus closes the second flow path when flush water is spouted from the pressurizing pump rim-side discharge portion, and closes the first flow path when flush water is spouted from the second valve apparatus.

The present invention thus constituted comprises a first flow path connecting the pressurizing pump rim-side discharge portion and the inflow prevention apparatus, a second flow path connecting the second valve apparatus and the inflow prevention apparatus, and a third flow path connecting the rim spout portion and the inflow prevention apparatus, wherein when water is spouted from the rim-side discharge portion of the pressurizing pump, the inflow prevention apparatus spouts water out of the rim spout portion to the bowl portion, and when water is spouted from the second valve apparatus the first flow path is closed, and water is spouted from the third flow path out of the rim spout portion into the bowl portion, therefore cross connection between the pressurizing pump rims-side discharge portion and the second valve apparatus can be prevented by a simple structure. As a result, wasting of water caused by flush water spouted from the pressurizing pump rim-side discharge portion or second valve apparatus flowing into portions other than the rim spout portion of the toilet main unit can be reliably constrained. Also, reverse flow and penetration of waste water to the pressurizing pump rim-side discharge portion and the second valve apparatus, respectively, can also be reliably constrained.

In the present invention, preferably, the rim spout portion includes a first rim spout portion connected to the rim-side discharge portion of the pressurizing pump, and a second rim spout portion connected to the second valve apparatus.

According to the invention thus constituted, because the toilet main unit rim spout portion includes a first rim spout portion connected to the pressurizing pump rim-side discharge portion, and a second rim spout portion connected to the second valve apparatus, a state in which the pressurizing pump rim-side discharge portion and the second valve apparatus communicate directly (known as a "cross connection") can be reliably prevented.

The present invention preferably further comprises a flush water amount measuring device for measuring the amount of flush water pressurized by the pressurizing pump and spouted from the storage tank to the toilet main unit; wherein the control device executes spouting of a predetermined amount of spout water from the rim spout portion by opening and closing the second valve apparatus based on the flush water amount measured by the spout water amount measuring device in the second sequence.

According to the invention thus constituted, because there is a flush water amount measuring device for measuring the amount of flush water pressurized by the pressurizing pump and spouted from the storage tank to the toilet main unit, and the control device executes spouting of a predetermined amount of spout water from the rim spout portion by opening the second valve apparatus based on the amount of flush water measured by the spout water amount measuring apparatus in the second sequence, simultaneous spouting from the rim spout portion and the jet spout portion, respectively, of the toilet main unit can be even more easily accomplished, and control responsive to the amount of spout water spouted from the storage tank to the toilet main unit is enabled.

The present invention preferably further comprises a flush water amount measuring device for measuring the amount of flush water pressurized by the pressurizing pump and spouted from the storage tank to the toilet main unit; wherein the control device executes spouting of a predetermined amount of spout water from the rim spout portion by opening the second valve apparatus based on the flush water amount measured by the spout water amount measuring device in the third sequence.

According to the invention thus constituted, because there is a flush water amount measuring device for measuring the amount of flush water pressurized by the pressurizing pump and spouted from the storage tank to the toilet main unit, and the control device executes spouting of a predetermined amount of spout water from the rim spout portion by opening the second valve apparatus based on the amount of flush water measured by the spout water amount measuring apparatus in the third sequence, control responsive to the amount of spout water spouted from the storage tank to the toilet main unit is enabled.

In the present invention the control device preferably opens only one of the first valve apparatus or the second valve apparatus during the period from the first through the third sequence.

According to the invention thus constituted, because only one of the first valve apparatus or the second valve apparatus is opened during the period from the first through the third sequence, flush water supplied from a water supply source can be stably spouted to the toilet main unit rim spout portion by routing it from the storage tank through the pressurizing pump when only the first valve apparatus is open, and can be stably spouted to the rim spout portion without routing it from the storage tank through the pressurizing pump when only the second valve apparatus is open.

In the present invention the spout water amount measuring device is preferably a water level sensor disposed inside the storage tank for measuring the water level inside the storage tank.

According to the invention thus constituted, the spout water amount measuring device is a water level sensor disposed inside the storage tank for measuring the water level inside the storage tank, therefore not only is control by the control device in response to the amount of spout water spouted from the storage tank to the toilet main unit enabled, but overflow of flush water from the storage tank can be constrained.

The present invention preferably further comprises a flow rate sensor disposed between the pressurizing pump and the rim spout portion, for measuring the instantaneous flow rate of flush water spouted from the rim spout portion.

The invention thus constituted comprises a flow rate sensor disposed between the pressurizing pump and the rim spout portion, for measuring the instantaneous flow rate of flush water spouted from the rim spout portion, therefore spouting control by a control device in response to the amount of spout water spouted from the storage tank to the toilet main unit can also be accurately performed by measuring the water level inside the storage tank.

Using the flush toilet of the present invention, the flush toilet as a whole can be made compact, and flush water supplied from a water supply source can be stably spouted even in a low fluid pressure environment.

DETAILED DESCRIPTION

Herein after, referring to the attached figures, we explain a flush toilet apparatus according to the first embodiment of the invention.

Figure 1:
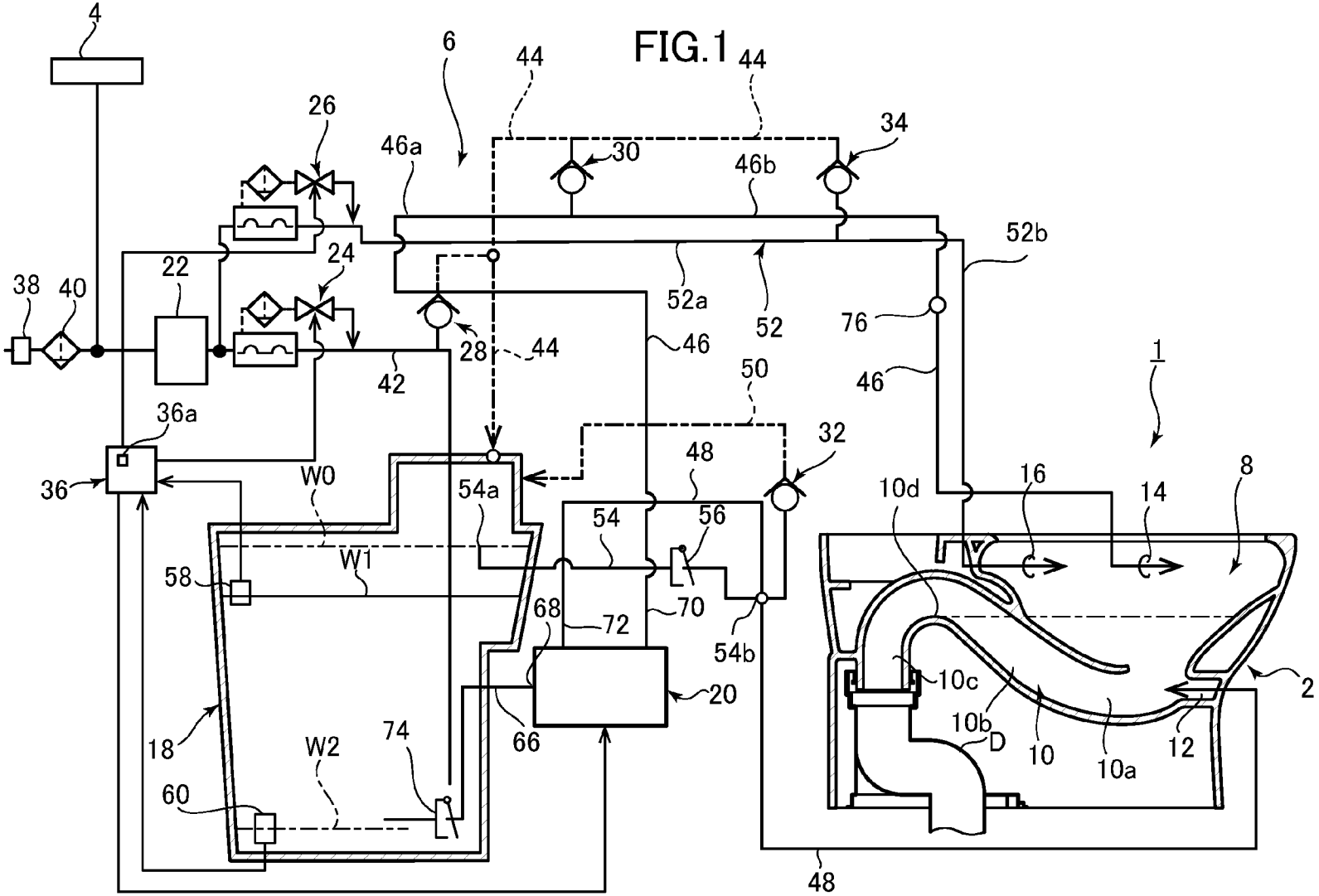
FIG. 1 is an overall schematic showing a flush toilet according to a first embodiment of the invention.

First, FIG. 1 is an overall schematic showing a flush toilet according to the first embodiment of the invention.

As shown in FIG. 1, a flush toilet 1 according to the first embodiment of the invention has a ceramic toilet main unit 2, and at the rear upper portion of this toilet main unit 2, a functional portion 6 including an extremity washing apparatus 4 is disposed.

Formed on the toilet main unit 2 are a bowl portion 8 for receiving waste, a discharge trap conduit 10 extending from the bottom portion of this bowl portion 8, a jet spout port 12 for jet spouting water, and a first rim spout port 14 and second rim spout port 16 for rim spouting.

The jet spout port 12 is formed on the bottom portion of the bowl portion 8; it is disposed essentially horizontally facing the inlet to the discharge trap conduit 10, and ejects flush water toward the discharge trap conduit 10.

The two rim spout ports 14, 16 are formed on the top side of the bowl portion 8, and eject flush water along the edge of the bowl portion 8.

The discharge trap conduit 10 is made up of an inlet portion 10*a*, a trap ascending pipe 10*b* which rises from this inlet portion 10*a*, and a trap descending pipe 10*c* descending from this trap ascending pipe 10*b*; between the trap ascending pipe 10*b* and the trap descending pipe 10*c* is an apex portion 10*d*.

In the flush toilet 1 of the present embodiment, a storage tank 18 is constituted to store flush water to be spouted from the spout port portion 20 through the jet spout port 12 and the second rim spout port 16, and for the jet spout water in the jet spout port 12 and the first rim spout water in the first rim spout port 14, as discussed in detail below, flush water stored in the storage tank 18 built into the functional portion 6 is pressurized by the pressurizing pump 20.

The flush toilet 1 is directly connected to the water main supplying flush water, and flush water is ejected from the second rim spout port 16 as second rim spout water under water main supply pressure.

Next, referring to FIG. 1, we explain in detail the functional portion 6 of a flush toilet 1 according to the first embodiment.

As shown in FIG. 1, a pressurizing pump 20, a fixed flow valve 22, an storage tank water supply electromagnetic valve 24, a second rim spout electromagnetic valve 26, a water storage tank supply vacuum breaker 28, a first rim supply vacuum breaker 30, a jet supply vacuum breaker 32, and a second rim spouting vacuum breaker 34 are built into the functional portion 6.

Also, a controller 36 for controlling manipulation of the opening and closing of the storage tank water supply electromagnetic valve 24, as well as the rpm of the forward and reverse rotation, activation time, etc. of the pressurizing pump 20 are built into the functional portion 6.

In addition, the controller 36 includes a timer 36*a*; the opening and closing operations of each of the electromagnetic valves 24 and the operation of the pressurizing pump 20, etc. can be controlled based on the time measured by this timer 36*a*.

The purpose of the fixed flow valve 22 is to constrict the flush water flowing in through the stop cock 38 and the strainer 40 to a predetermined flow rate.

Also, flush water which has passed through the fixed flow valve 22 flows respectively into the electromagnetic valves 24 and 26, and flush water which has passed through the electromagnetic valve 24 for supplying the storage tank is supplied to the storage tank 18.

At the same time, flush water which as passed through the second rim spout electromagnetic valve 26 is supplied to the first rim spout port 14.

I.e., each of the electromagnetic valves 24, 26 is opened and closed by a control signal from the controller 36; flush water supplied to each of the electromagnetic valves 24, 26 is caused to flow respectively into the storage tank 18 and the first rim spout port 16 or is stopped.

The water storage tank supply vacuum breaker 28 is disposed midway along the storage tank-side water supply conduit 42 for directing flush water which has passed from the fixed flow valve 22 through the electromagnetic valve 24 for supplying the storage tank, and into the storage tank 18, thereby preventing the reverse flow of flush water from the storage tank 18.

Also, flush water spilling over from the open-to-the-air-portion of the water storage tank supply vacuum breaker 28 flows into the storage tank 18 through a return conduit 44.

The first rim supply vacuum breaker 30 is disposed midway along the first rim-side water supply path 46 directing flush water which has passed from the storage tank 18 through the pressurizing pump 20 to the first rim spout port 14, functioning as a reverse flow prevention apparatus which prevents the reverse flow of flush water from the first rim spout port 14 and prevents flush water spouted from the rim-side discharge portion 70 of the pressurizing pump 20 from flowing into portions other than the first rim spout port 14 on the toilet main unit 2.

Also, flush water spilling over from the atmosphere-exposed part of the first rim supply vacuum breaker 30 flows into the storage tank 18 through a return conduit 44.

The jet supply vacuum breaker 32 is disposed along the jet-side water supply path 48, which conducts flush water which has passed from the storage tank 18 through the pressurizing pump 20 to the jet spout port 12, and prevents reverse flow of flush water to the pressurizing pump 20 from the jet spout port 12.

Also, flush water spilling over from the atmosphere-exposed portion of the jet supply vacuum breaker 32 flows into the storage tank 18 through a return conduit 50.

The second rim spouting vacuum breaker 34 is disposed along the second rim-side supply path 52 for directing flush water which has passed from the fixed flow valve 22 through the second rim spout electromagnetic valve 26 to the second rim spout port 16, and prevents reverse flow from the second rim spout port 16, functioning as an inflow prevention apparatus for preventing inflow of flush water (direct pressure water main water) which has passed through the second rim spout electromagnetic valve 26 into any portion other than the second rim spout port 16.

Also, flush water spilling over from the open to the air portion of the second rim spouting vacuum breaker 34 flows into the storage tank 18 through a return conduit 44.

Moreover, the first rim-side water supply path 46 includes a first flow path 46*a* connecting the pressurizing pump 20 rim-side discharge portion 70 and first rim supply vacuum breaker 30, and a second flow path 46*b* connecting the first rim spout port 14 and the first rim supply vacuum breaker 30, while the second rim-side supply path 52 includes a first flow path 52*a* connecting the second rim spout electromagnetic valve 26 and the second rim spouting vacuum breaker 34, and a second flow path 52*b* connecting the second rim spout port 16 and the second rim spouting vacuum breaker 34.

By the above means, when water is spouted from the pressurizing pump 20 rim-side discharge portion 70 through the first rim-side water supply path 46 to the first rim spout port 14, the second rim spouting vacuum breaker 34 closes the first flow path 52*a* on the second rim-side supply path 52 so that water can be spouted from the first rim-side water supply path 46 second flow path 46*b* to the bowl portion 8 by the first rim spout port 14.

On the other hand, in cases where water is spouted from the second rim spout electromagnetic valve 26 through the second rim-side supply path 52 to the second rim spout port 16, the first rim supply vacuum breaker 30 can close the first rim-side water supply path 46 first flow path 46*a* so that water is spouted from the second rim-side supply path 52 second flow path 52*b* out of the second rim spout port 16 into the bowl portion 8.

Also, an overflow path 54 is provided between the storage tank 18 and the jet-side water supply path 48; the top end 54*a* of this overflow path 54 opens inside the storage tank 18, and the bottom end 54*b* thereof is connected to the jet-side water supply path 48.

A flapper valve 56 is disposed on this overflow path 54; this flapper valve 56 prevents reverse flow from the second rim spout port 16 to the storage tank 18, and serves as a partition between the storage tank 18 and the jet-side water supply path 48.

Also, in the present embodiment a top end float switch 58 and bottom end float switch 60 are respectively disposed inside the storage tank 18 as water level sensors, being spout water amount sensing devices for sensing the amount of flush water pressurized by the pressurizing pump 20 and spouted from the storage tank 18 to the toilet main unit 2 and outputting that sensed signal to the controller 36, so that the water level inside the storage tank 18 can be detected. The top end float switch 58 switches on when the water level inside the storage tank 18 reaches a predetermined water level W1 and the controller 36 senses this and closes off the storage tank water supply electromagnetic valve 24. On the other hand the bottom end float switch 60 switches on when the water level in the storage tank 18 drops to a predetermined water level W2, and the controller 36 senses this and turns off the pressurizing pump 20.

Next, referring to FIGS. 1, 2A, and 2B, we explain the pressurizing pump 20 on the flush toilet 1 of the present embodiment.

Here FIG. 2A is summary plan view of a flush toilet pressurizing pump according to the first embodiment of the invention; FIG. 2B is a summary side view cross section of a flush toilet pressurizing pump according to the first embodiment of the invention.

First, as shown in FIGS. 2A and 2B, a pressurizing pump 20 includes a casing 62 and a reversible rotary impeller 64, being a bladed wheel mounted so as to be rotatable in both the forward and reverse directions in the casing 62, and a motor (not shown) for turning the impeller 64 by a command from the controller 36; the pump is a reversible rotation centrifugal pump for pressure feeding flush water in the storage tank 18 using centrifugal force from rotation of the impeller 64.

Also, as shown in FIGS. 1, 2A, and 3B, disposed at the top portion of the casing 62 is a suctioning portion 68, connected to the flush water conduit 66 extending from the storage tank 18 (see FIG. 1) and suctioning flush water in the storage tank 18 from the flush water conduit 66 into the casing 62 by the forward direction and reverse direction rotation of the impeller 64.

In addition, as shown in FIGS. 1, 2A, and 2B, a rim-side discharge portion 70 connected to the first rim-side water supply path 46, and a jet-side discharge portion 72 are respectively disposed on the outer perimeter portion of the casing 62.

For example, when the impeller 64 is rotating in the forward direction, flush water in the casing 62 is discharged from the jet-side discharge portion 72 through the jet-side water supply path 48 to the jet spout port 12.

On the other hand if the impeller 64 rotates in the reverse direction, flush water in the casing 62 is discharged from the rim-side discharge portion 70 through the first rim-side water supply path 46 to only the first rim spout port 14.

Note than in the present embodiment we explain an embodiment in which, when the impeller 64 is rotating forward, flush water in the casing 62 is discharged from the jet-side discharge portion 72 through the jet-side water supply path 48 to the jet spout port 12, but without such limitation the embodiment may also be one in which, when the impeller 64 is rotating forward, flush water in the casing 62 is discharged from the jet-side discharge portion 72 through the jet-side water supply path 48 to only the jet spout port 12, and flush water in the casing 62 can be discharged from the rim-side discharge portion 70 through the first rim-side water supply path 46 to the first rim spout port 14. When the impeller 64 is rotating in the reverse direction, flush water in the casing 62 is discharged from the rim-side discharge portion 70 through the first rim-side water supply path 46 to only the first rim spout port 14, and an embodiment is also possible in which an amount of flush water less than the amount of that discharged flush water is discharged from the jet-side discharge portion 72 to the jet-side water supply path 48. This embodiment enables the constraining of the reverse flow of flush water from the jet-side water supply path 48 through the jet-side discharge portion 72.

Also, as shown in FIG. 1, a flapper valve 74 is disposed along the flush water conduit 66 between the storage tank 18 and the pressurizing pump 20, and flush water in the pressurizing pump 20 casing 62 can be prevented from flowing in reverse from the flush water conduit 66 to the storage tank 18, thus causing flush water inside the pressurizing pump 20 casing 62 to drain out and deplete the priming water inside the casing 62 at the start of pressurizing pump 20 operation when the water level inside the storage tank 18 falls below the height of the pressurizing pump 20, or the impeller 64 rotating in one direction temporarily stops and changes to a rotation in the other direction.

Note that as a measure for preventing the loss of priming water inside the pressurizing pump 20 casing 62 in this manner, the position of the jet-side water supply path 48 can be set above the position of the pressurizing pump 20 jet-side discharge portion 72 so that when the pressurizing pump 20 stops, flush water inside the jet-side water supply path 48 connected to the pressurizing pump 20 jet-side discharge portion 72 acts has a head pressure inside the casing 62, or the position of the first rim-side water supply path 46 can be set above the position of the pressurizing pump 20 rim-side discharge portion 70 so that flush water in the first rim-side water supply path 46 connected to the pressurizing pump 20 rim-side discharge portion 70 acts as a head pressure inside the casing 62. Or, the pressurizing pump 20 position can be set below the storage tank 18 so that the pressure of the flush water in the storage tank 18 constantly acts as a head pressure in the pressurizing pump 20 casing 62.

In addition, a flow rate sensor 76 for sensing the instantaneous flow rate of flush water spouted from the first rim spout port 14 is disposed along the first rim-side water supply path 46 between the pressurizing pump 20 and the first rim spout port 14.

Figure 2:
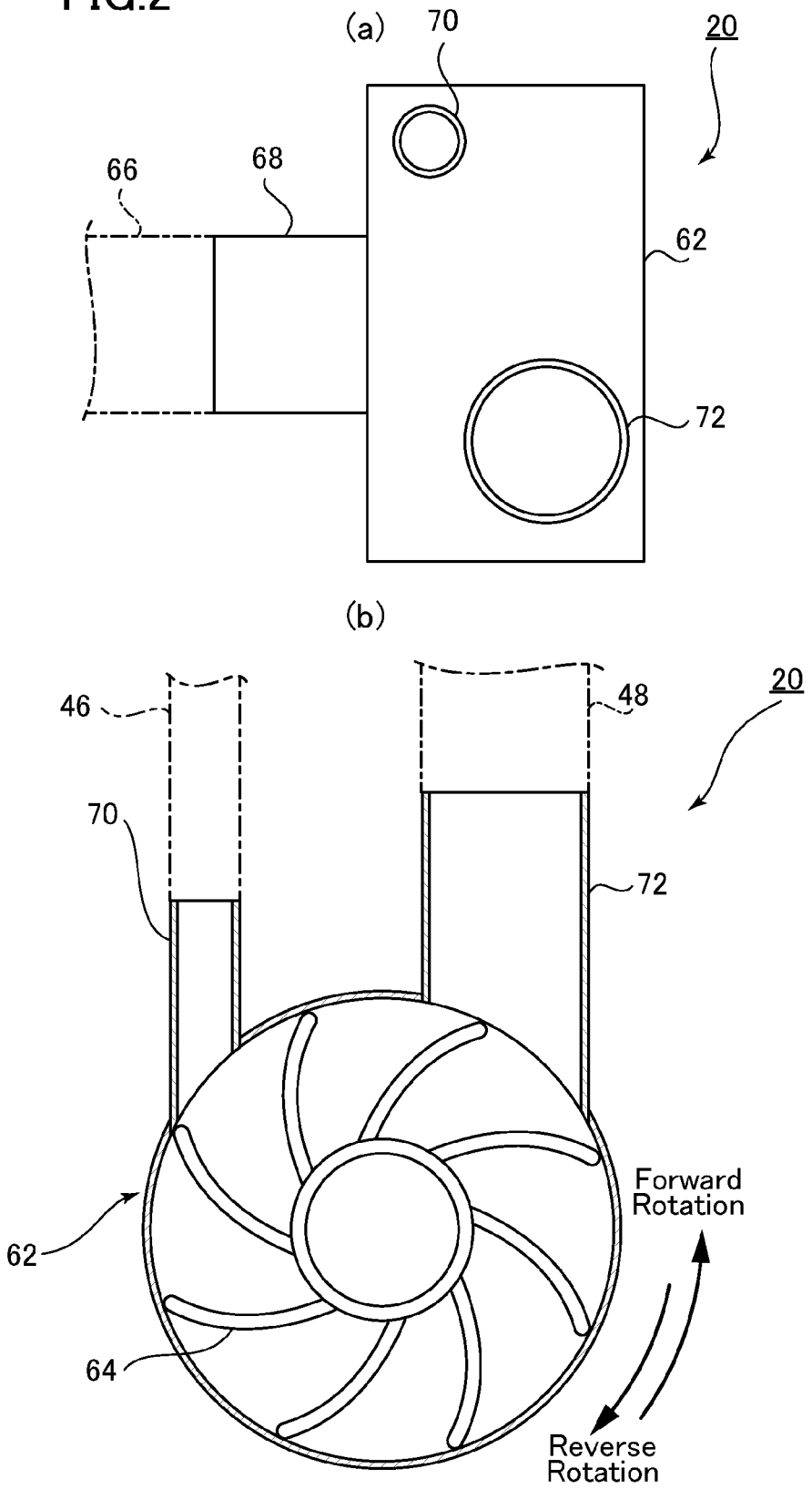
FIG. 2A is a summary plan view of a flush toilet pressurizing pump according to the first embodiment of the invention.
FIG. 2B is a summary side view cross section of a flush toilet pressurizing pump according to the first embodiment of the invention.
Figure 3:
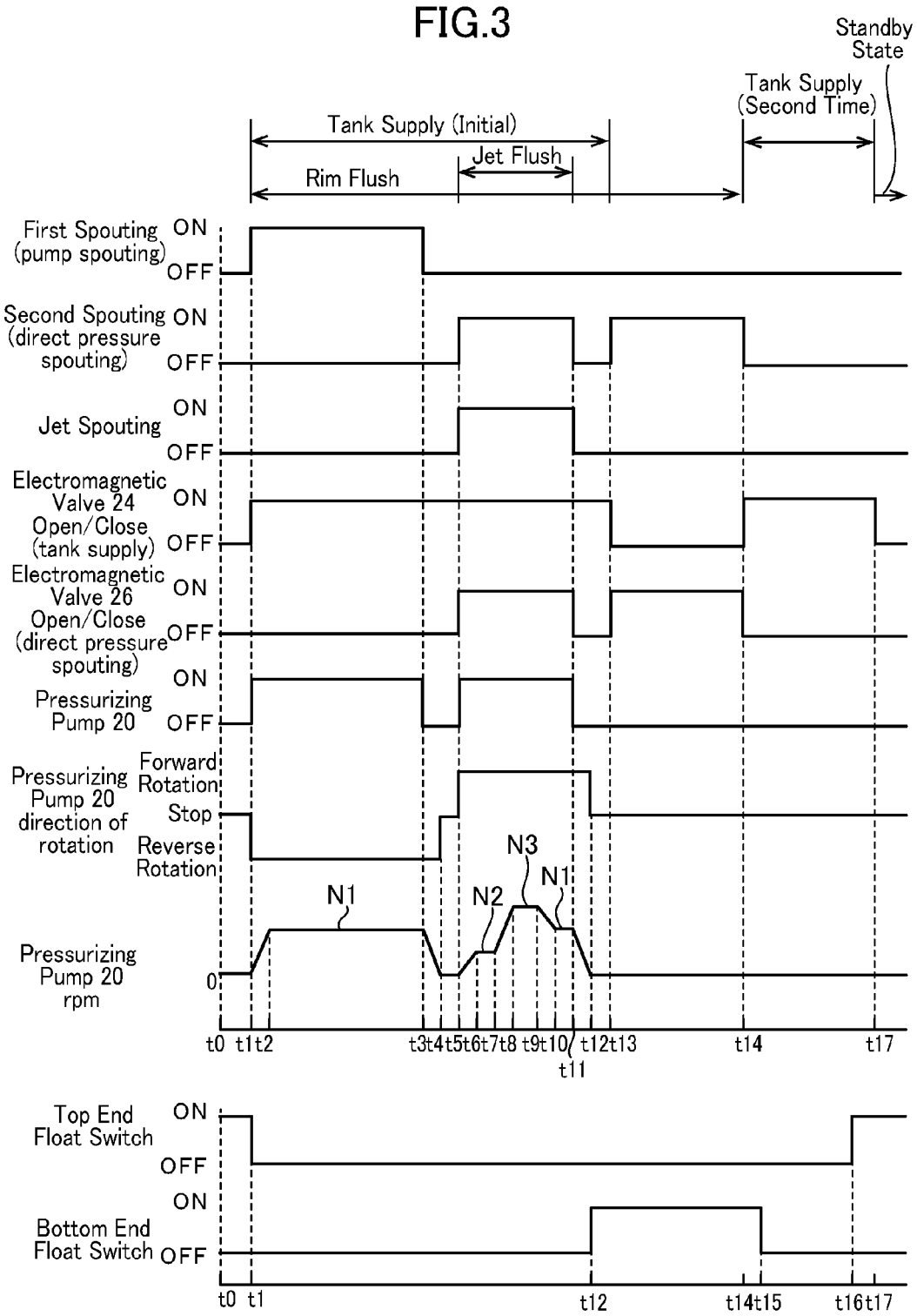
FIG. 3 is a flow chart showing the basic operations of a flush toilet according to the first embodiment of the invention.

Next, referring to FIGS. 1 through 3, we explain the operation (action) of the flush toilet 1 according to the above-described first embodiment of the invention.

FIG. 3 is a flow chart showing the basic operations of a flush toilet according to the first embodiment of the invention. First, as shown in FIG. 3, in the standby state (time t0-t1), the water level of flush water in the storage tank 18 is at a predetermined upper limit water level W1 below the full water level W0 corresponding to the top end 54*a* of the overflow path 54, and because this water level W1 reaches the top end float switch 58, the top end float switch 58 is on.

At time t1, when a user operates a toilet flush switch (not shown), the controller 36 sends a signal to the storage tank water supply electromagnetic valve 24 opening the valve, and sends a signal to the first rim spout water supply electromagnetic valve 24, closing the valve.

The pressurizing pump 20 is turned on by control from the controller 36, the initial first spouting (front rim flush) by the first rim spout port 14 is started, and following this up to time t3, the controller executes a first sequence. The execution of this first sequence results in flush water inside the storage tank 18 being supplied through the pressurizing pump 20 to the first rim-side water supply path 46, and a predetermined amount of flush water being ejected from the first rim spout port 14.

Here the storage tank water supply electromagnetic valve 24 is open from times t1 to t13, and flush water supplied from the water main flows into the fixed flow valve 22 through the stop cock 38 and the strainer 40.

In addition, in the fixed flow valve 22 when the water main supply pressure is high, the flow rate of transiting flush water is limited to a predetermined flow rate; when the supply pressure is low, flush water passes through unhindered, without being flow-limited. Then flush water which has flowed through the fixed flow valve 22 passes through the storage tank water supply electromagnetic valve 24, flows through the storage tank-side water supply conduit 42, passes through the storage tank supply vacuum breaker 28, and flows into the storage tank 18.

In addition, when the pressurizing pump 20 turns on at time t1, the impeller 64 rotates in the reverse direction and accelerates until the impeller 64 rpm N reaches a predetermined rpm N1 at time t2.

Then, following time t2, the first rim-side water supply path 46 rotates at a constant rpm N1 in the reverse direction; the pressurizing pump 20 turns off at time t3, and the impeller 64 decelerates; thereafter, the impeller 64 rpm goes to 0 at time t4, and the pressurizing pump 20 substantially stops.

As a result of this rotation of the pressurizing pump 20 impeller 64 in the reverse direction from times t1 through t4, flush water in the storage tank 18 passes through the flush water conduit 66 and is suctioned from the pressurizing pump 20 suctioning portion 68 into the casing 62, then is pressure fed from the pressurizing pump 20 rim-side discharge portion 70 to the first rim-side water supply path 46. Flush water in the first rim-side water supply path 46 is spouted from the first rim spout port 14 at a predetermined instantaneous flow rate Q1 [L/min] (e.g., Q1=10 L/min) as first rim spout water (see FIG. 3). Flush water spouted from the first rim spout port 14 flows down as it circulates in the bowl portion 8, cleaning the inside wall surface of the bowl portion 8.

Note that the instantaneous flow rate Q1 of flush water in the first rim-side water supply path 46 is sensed by the flow rate sensor 76; this sensed signal is transmitted to the controller 36, and the pressurizing pump 20 is controlled so that the spouted water amount in the first rim spout port 14 is a predetermined amount.

From times t1 to t5, on the other hand, because the second rim spout electromagnetic valve 26 is closed, no second rim spouting (see FIG. 3) by the second rim spout port 16 is carried out.

In addition, during the time the impeller 64 is rotating in the reverse direction (t1 to t4), flush water is supplied from the pressurizing pump 20 jet-side discharge portion 72 to the jet-side water supply path 48, therefore no jet spouting from the jet spout port 12 is performed (see FIG. 3).

Also, as shown in FIG. 3, after time t1 flush water in the storage tank 18 is suctioned through the flush water conduit 66 into the pressurizing pump 20 suctioning portion 68 by the operation of the pressurizing pump 20, therefore the water level in the storage tank 18 drops below the upper limit water level W1 sensed by the top end float switch 58, and the top end float switch 58 turns off.

On the other hand, because the water level inside storage tank 18 is above a predetermined lower limit water level W2, the bottom end float switch 60 is in an off state.

Next, as shown in FIG. 3, from times t5 to t11, the controller 36 executes a second sequence; flush water in the storage tank 18 is supplied through the pressurizing pump 20 to the jet-side water supply path 48 and flushing by jet spout water spouted in a predetermined amount from the jet spout port 12 is performed, while the second rim spout electromagnetic valve 26 is opened and flushing (mid-rim flushing) by only water main second rim spout water supplied from the second rim-side supply path 52 to the second rim spout port 16 is performed.

Specifically, the pressurizing pump 20 again turns on under control of the controller 36 at time t5; the pressurizing pump 20 impeller 64 rotates in the forward direction, and after the impeller 64 rpm N reaches rpm N2 at time t6, it rotates in the forward direction at a constant predetermined rpm N2 until time t7.

Note that this predetermined rpm N2 is set to be smaller than a predetermined rpm N1 from time t2 until time t3.

At time t3 the pressurizing pump 20 turns off and the first sequence ends; at time t5 the pressurizing pump 20 again turns on, and the time until the second sequence starts (t5-t3) is the time lag (t5-t3) until the pressurizing pump 20 impeller 64 switches over from a reverse direction rotation to a forward direction rotation; this time lag (t5-t3) is set, for example, to 0.5 msec. During this interval, particularly at time t4, even if the impeller 64 is substantially stopped, a reverse flow of flush water in the pressurizing pump 20 casing 62 from the flush water conduit 66 to the storage tank 18 causing flush water in the pressurizing pump 20 casing 62 to drain out and priming water inside the casing 62 to be lost is prevented by the flapper valve 74 midway along the flush water conduit 66 between the storage tank 18 and the pressurizing pump 20.

In addition, at time t7 to t8 the impeller 64 accelerates until the impeller 64 rpm N reaches the maximum predetermined rpm N3, greater than rpm N1 and, at time t8 to t9, the impeller 64 rotates in the forward direction at a constant predetermined rpm N3.

At time t9 to t10, the impeller 64 decelerates from the maximum predetermined rpm N3 to the predetermined rpm N1; at time t10 to t11, the impeller 64 rotates in the forward direction at a predetermined rpm N1. The pressurizing pump 20 then turns off at time t11; the impeller 64 decelerates, and subsequently at time t12 the impeller 64 rpm N goes to 0; the pressurizing pump 20 substantially stops, after which the pressurizing pump 20 is maintained in a stopped state until the following second toilet flush is started.

I.e., when a first jet spouting by the jet spout port 12 is started by the operation of the pressurizing pump 20 caused by the second sequence in these times t5 to t11, flush water inside the storage tank 18 is suctioned through the flush water conduit 66 from the pressurizing pump 20 suctioning portion 68 into the casing 62, then pressure fed to the respective jet-side water supply paths 48 from the pressurizing pump 20 jet-side discharge portion 72. Flush water in the jet-side water supply path 48 is then spouted as jet spout water (see FIG. 3) from the jet spout port 12 at a predetermined instantaneous flow rate Q2 [L/min] (e.g., Q2=85 L/min), flowing into the discharge trap conduit 10 and filling the discharge trap conduit 10 so as to induce a siphon phenomenon. This siphon phenomenon results in pooled water and waste in the bowl portion 8 being suctioned into the discharge trap conduit 10 and discharged from the discharge pipe D.

At the same time, at times t5 to t11, the second rim spout electromagnetic valve 26 opens and flush water which has passed through the second rim-side supply path 52 (direct pressure water main water) is spouted as second rim spout water from the second rim spout port 16 at a predetermined instantaneous flow rate Q3 [L/min] (e.g., Q3=6 L/min), flowing downward as it circulates in the bowl portion 8, cleaning the inside wall surface of the bowl portion 8.

Note that in the present embodiment we explain an example whereby in the second sequence from time t5 to t11, a second rim spouting is performed from the second rim spout port 16, but instead of performing a second rim spouting from the second rim spout port 16, it is also acceptable for the second rim spout electromagnetic valve 26 to close, at the same time performing a first spouting from the pressurizing pump 20 rim-side discharge portion 70 through the first rim-side water supply path 46 and out the first rim spout port 14 so that water is spouted simultaneously from the jet spout port 12 and the first rim spout port 14, respectively, on the toilet main unit 2.

Alternatively, as still another variant example, during the second sequence between times t5 and t11, water can also be conserved by jetting water at the jet spout port 12 only, performing no first rim spouting by the first rim spout port 14 or second rim pouting by the second rim spout port 16.

Next, after the second rim spout electromagnetic valve 26 is closed at time t11 and flushing (mid-rim flushing) by a second rim spouting and a jet spouting in the second sequence is completed, the bottom end float switch 60 turns on when the water level inside the storage tank 18 drops to the lower limit water level W2 at around time t12.

Then, at time t13 to t14, the storage tank water supply electromagnetic valve 24 closes, and the second rim spout electromagnetic valve 26 again opens, thereby executing a third sequence in which flushing (rear rim flushing) by only second rim spouting of water main water supplied from the second rim-side supply path 52 to the second rim spout port 16 is carried out at a predetermined instantaneous flow rate Q4 [L/min] (e.g., Q4=6 L/min).

Here, after time t1, and after the water level in the storage tank 18 falls below the position of the top end float switch 58 due to activation of the pressurizing pump 20 so that the top end float switch 58 turns off, when the water level in the storage tank 18 falls below the lower limit water level W2 at around time t12 and the bottom end float switch 60 turns on, a total spouted water amount is sensed, being the amount of water spouted at the first rim spout port 14 by the pressurizing pump 20 in the first sequence and the amount of water spouted at the jet spout port 12 by the pressurizing pump 20 in the first sequence, and the controller 36 closes the second rim spout electromagnetic valve 26 in a third sequence from time t13 to t14 based on this sensed spout water amount.

Next, at time t14, the storage tank water supply electromagnetic valve 24 again opens, the second rim spout electromagnetic valve 26 again closes, and water is supplied at a predetermined instantaneous flow rate Q5 [L/min] (e.g., Q5=6 L/min) from the storage tank-side water supply conduit 42 to the storage tank 18, such that the water level in the storage tank 18 rises.

Then at time t15, when the water level in the storage tank 18 rises to a predetermined lower limit water level W2, the bottom end float switch 60 turns off and the water level in the storage tank 18 rises and reaches a predetermined upper limit water level W1 at time t1, the top end float switch 58 turns on.

Then at time t17, the storage tank water supply electromagnetic valve 24 closes and the storage tank 18 reaches an essentially full state; subsequent to time t17, the same state as the above-described standby state (time t0 to t1) applies until the next second toilet flush is started.

As described above, the pressurizing pump 20 is a centrifugal pump different from a vacuum pump, and cannot perform the function of a pump without priming water in the casing 62, therefore when starting the next toilet flush a sufficient amount of flush water is stored in the storage tank 18, and activation of course begins after the interior of the pressurizing pump 20 casing 62 is in all cases filled with priming water or the like; even when performing a restore operation after an emergency stopping of the pressurizing pump 20, activation in all cases occurs with the interior of the casing 62 filled with flush water.

According to the flush toilet 1 of the above-described first embodiment of the invention, the pressurizing pump 20 is a reversible rotation centrifugal pump capable of rotation in the forward direction and reverse direction, therefore when the impeller 64 is rotating in the reverse direction, flush water in the storage tank 18 is spouted to the rim-side discharge portion 70 of the pressurizing pump 20 so that water can be spouted from the toilet main unit 2 first rim spout port 14 to execute a rim flush.

On the other hand when the impeller 64 is rotating in the forward direction, flush water in the storage tank 18 is spouted to the pressurizing pump 20 jet-side discharge portion 72, so that a jet flush can be executed by spouting water from the toilet main unit 2 jet spout port 12.

As a result, even when the flush water supply to the toilet main unit 2 directly connected to the water main serving as water source is used in a low-pressure environment (e.g., less than 0.05 Mpa), stable spouting can be carried out using spout water from the pressurizing pump 20. Also, because a reversible rotation centrifugal pump furnished with the reversible rotary impeller 64 capable of rotating in the forward and reverse directions is used as the pressurizing pump 20, rim spouting and jet spouting can be easily performed using only spouting by the pressurizing pump 20.

In addition, there is no need to use a device other than the pressurizing pump 20 for adjusting the flow rate of flush water supplied from the storage tank 18 to the first rim spout port 14 and the jet spout port 12 of the toilet main unit 2, and because the occupied space required for this equipment other than the pressurizing pump 20 can be eliminated, the overall flush toilet 1 can be reduced in size.

In addition, according to the flush toilet 1 of the present embodiment, a controller executes a first sequence in which the pressurizing pump 20 is controlled to spout a predetermined amount of flush water from the storage tank 18 to the first rim spout port 14, then a second sequence in which the pressurizing pump 20 is controlled so that a predetermined amount of flush water is spouted from the storage tank 18 to only the jet spout port 12, therefore water can be conserved compared to the case in which a pressurizing pump is controlled so that a predetermined amount of flush water is simultaneously spouted from the storage tank 18 to both the first rim spout port 14 and the jet spout port 12.

Also, according to the flush toilet 1 of the present embodiment, a valve apparatus for spouting and stopping flush water supplied from a water source to the storage tank 18 or the pressurizing pump 20 includes a storage tank water supply electromagnetic valve 24 for spouting water to the first rim spout port 14 or the jet spout port 12 by causing flush water supplied from a water supply source to be spouted or stopped to the storage tank 18 and passed through the pressurizing pump 20, and a second rim spout electromagnetic valve 26 for spouting water to the second rim spout port 16 without passing the flush water supplied from a water supply source through the storage tank 18 and the pressurizing pump 20, therefore in a state whereby the second rim spout electromagnetic valve 26 is open, flush water (water main direct pressure flush water) can be directly spouted to the second rim spout port 16 without passing through the storage tank 18.

As a result, in the second sequence between times t5 and t11, for example, the storage tank water supply electromagnetic valve 24 and the second rim spout electromagnetic valve 26 can respectively be simultaneously opened, and simultaneous spouting from the toilet main unit 2 second rim spout port 16 and jet spout port 12 can be easily accomplished.

In addition, according to the flush toilet 1 of the present embodiment, based on a predetermined time (t11-t5) measured by the timer 36*a*, the controller 36 can, during in the second sequence from time t5 to t11, cause the pressurizing pump 20 to rotate in the forward direction and open the second rim spout electromagnetic valve 26 for a predetermined time (t11-t5), and simultaneous spouting from the toilet main unit 2 second rim spout port 16 and the jet spout port 12 respectively can be easily accomplished.

Also, according to the flush toilet 1 of the present embodiment, in addition to the provision of a first rim supply vacuum breaker 30 for preventing reverse flow of flush water from the first rim spout port 14 and preventing the inflow of flush water spouted from the pressurizing pump 20 rim-side discharge portion 70 to anywhere other than the toilet main unit 2 first rim spout port 14 along the first rim-side water supply path 46 for guiding flush water passing from the storage tank 18 through the pressurizing pump 20 to the first rim spout port 14, a second rim spouting vacuum breaker 34 for preventing a reverse flow from the second rim spout port 16 and preventing inflow of flush water (direct pressure water main water) passing through the second rim spout electromagnetic valve 26 to anywhere other than the toilet main unit 2 second rim spout port 16 is provided along the second rim-side supply path 52 guiding flush water passing through the second rim spout electromagnetic valve 26 from the fixed flow valve 22 to the second rim spout port 16, therefore a state in which the pressurizing pump 20 rim-side discharge portion 70 and second rim spout electromagnetic valve 26 directly communicate ("cross connection") can be prevented.

Hence the occurrence of wasted water resulting from the inflow of flush water spouted from the pressurizing pump 20 rim-side discharge portion 70 into anywhere other than the toilet main unit 2 first rim spout port 14 can be constrained, and the occurrence of wasted water resulting from the inflow of flush water (direct pressure water main water) spouted from the second rim spout electromagnetic valve 26 to the second rim-side supply path 52 into anywhere other than the second rim spout port 16 can be constrained. The reverse flow and penetration of waste water to the pressurizing pump 20 rim-side discharge portion 70 and the second rim spout electromagnetic valve 26, respectively, can be constrained.

Furthermore, according to the flush toilet 1 of the present embodiment, the first rim-side water supply path 46 includes a first flow path 46*a* connecting the pressurizing pump 20 rim-side discharge portion 70 and the first rim supply vacuum breaker 30, and a second flow path 46*b* connecting the first rim spout port 14 and the first rim supply vacuum breaker 30, while the second rim-side supply path 52 includes a first flow path 52*a* connecting the second rim spout electromagnetic valve 26 and the second rim spouting vacuum breaker 34, and a second flow path 52*b* connecting the second rim spout port 16 and the second rim spouting vacuum breaker 34, such that when water is spouted to the first rim spout port 14 from the pressurizing pump 20 rim-side discharge portion 70 through the first rim-side water supply path 46, the second rim spouting vacuum breaker 34 closes the second rim-side supply path 52 first flow path 52*a*, and water can be spouted from the first rim-side water supply path 46 second flow path 46*b* out of the first rim spout port 14 into the bowl portion 8.

On the other hand, in cases where water is spouted from the second rim spout electromagnetic valve 26 through the second rim-side supply path 52 to the second rim spout port 16, the first rim supply vacuum breaker 30 can close the first rim-side water supply path 46 first flow path 46*a* so that water is spouted from the second rim-side supply path 52 second flow path 52*b* out of the second rim spout port 16 into the bowl portion 8.

Hence a cross connection between the pressurizing pump 20 rim-side discharge portion 70 and the second rim spout electromagnetic valve 26 can be easily prevented using a simple configuration.

Thus the occurrence of wasted water resulting from the inflow of flush water spouted to the first rim-side water supply path 46 from the pressurizing pump 20 rim-side discharge portion 70 into anywhere other than the toilet main unit 2 first rim spout port 14 can be reliably constrained, and the occurrence of wasted water resulting from the inflow of flush water (direct pressure water main water) spouted from the second rim spout electromagnetic valve 26 to the second rim-side supply path 52 into anywhere other than the second rim spout port 16 can be reliably constrained. Moreover, reverse flow and penetration of waste water to the pressurizing pump 20 rim-side discharge portion 70 and the second rim spout electromagnetic valve 26, respectively, can also be reliably constrained.

In addition, according to the flush toilet 1 of the present embodiment the toilet main unit 2 includes a first rim spout port 14 connected through the pressurizing pump 20 rim-side discharge portion 70 and first rim-side water supply path 46, and a second rim spout port 16 connected through the second rim spout electromagnetic valve 26 and the second rim-side supply path 52, such that a state in which the pressurizing pump 20 rim-side discharge portion 70 and first rim-side water supply path 46 directly communicate with the second rim spout electromagnetic valve 26 and the second rim-side supply path 52 (known as a "cross connection") can be reliably prevented.

Note that in the flush toilet 1 of the present embodiment we explained an example whereby in a second sequence from time t5 to t11 the controller 36 causes the pressurizing pump 20 to rotate in the forward direction for a predetermined time and the second rim spout electromagnetic valve 26 to open for a predetermined time (t11-t5) based on a predetermined time (t11-t5) measured by the timer 36*a*, so that simultaneous spouting is performed from the second rim spout port 16 and the jet spout port 12, respectively, but this may also be applied to other variant examples.

For example, as another variant example, instead of the controller 36 responding to a time measured by the timer 36*a* in the second sequence, a predetermined amount of flush water supplied from the storage tank 18 through the pressurizing pump 20 to the jet spout port 12 could be sensed based on information sensed by the top end float switch 58 and the bottom end float switch 60, and the second rim spout electromagnetic valve 26 opened based on this sensed flush water amount to perform a second rim spouting by the second rim spout port 16, or a predetermined amount of flush water supplied from the storage tank 18 through the pressurizing pump 20 to the first rim spout port 14 could be sensed based on information sensed by the flow rate sensor 76 to open the second rim spout electromagnetic valve 26 and perform a second rim spouting by the second rim spout port 16. By these means, simultaneous spouting from the second rim spout port 16 and the jet spout port 12 respectively could thus be easily accomplished, and spout control responsive to the amount of spout water spouted from the storage tank 18 to the toilet main unit 2 made possible.

Moreover, using a flush toilet 1 according to the present embodiment, a top end float switch 58 and a bottom end float switch 60 are respectively disposed inside the storage tank 18 as water level sensors, being spout water amount sensing devices for sensing the amount of flush water pressurized by the pressurizing pump 20 and spouted from the storage tank 18 to the toilet main unit 2 and outputting that sensed signal to the controller 36.

Therefore after time t1, and after the water level in the storage tank 18 falls below the position of the top end float switch 58 due to activation of the pressurizing pump 20 so that the top end float switch 58 turns off, when the water level in the storage tank 18 falls below the lower limit water level W2 at around time t12 and the bottom end float switch 60 turns on, a total spouted water amount can be sensed, being the amount of water spouted at the first rim spout port 14 by the pressurizing pump 20 in the first sequence and the amount of water spouted at the jet spout port 12 by the pressurizing pump 20 in the first sequence. Thus based on this sensed spouted water amount, the controller 36 opens the second rim spout electromagnetic valve 26 in the third sequence from time t13 to t14, so that a predetermined amount of spout water from the second rim spout port 16 can be reliably executed, thereby enabling spout control by the controller 36 in response to amount of water spouted from the storage tank 18 to the toilet main unit 2.

Moreover, overflow of flush water from the storage tank 18 can be constrained.

In addition, using the flush toilet 1 of the present embodiment, in the first sequence from time t1 to t3 when only the storage tank water supply electromagnetic valve 24 is open, water can be stably spouted to the toilet main unit 2 first rim spout port 14 by passing flush water supplied from a water supply source from the storage tank 18 through the pressurizing pump 20.

Also, when only the storage tank water supply electromagnetic valve 24 is open during the period from t14 to t17, water can be reliably supplied from a water supply source to the storage tank 18.

On the other hand in the third sequence from time t13 to t14, when only the second rim spout electromagnetic valve 26 is open, flush water supplied from a water supply source can be reliably spouted to the second rim spout port 16 without passing through the storage tank 18 and the pressurizing pump 20.

Using a flush toilet 1 according to the present embodiment, a flow rate sensor 76 for sensing an instantaneous flow rate Q1 of flush water spouted from the first rim spout port 14 is disposed along the first rim-side water supply path 46 between the pressurizing pump 20 and the first rim spout port 14; a signal sensed by this flow rate sensor 76 is sent to the controller 36, and the pressurizing pump 20 is controlled so that the spout water amount at the first rim spout port 14 is a predetermined amount, therefore spout control by the controller 36 in response to the amount of water spouted at the toilet main unit 2 first rim spout port 14 from the storage tank 18 can be more accurately performed than by sensing the water level inside the storage tank 18.

Figure 4:
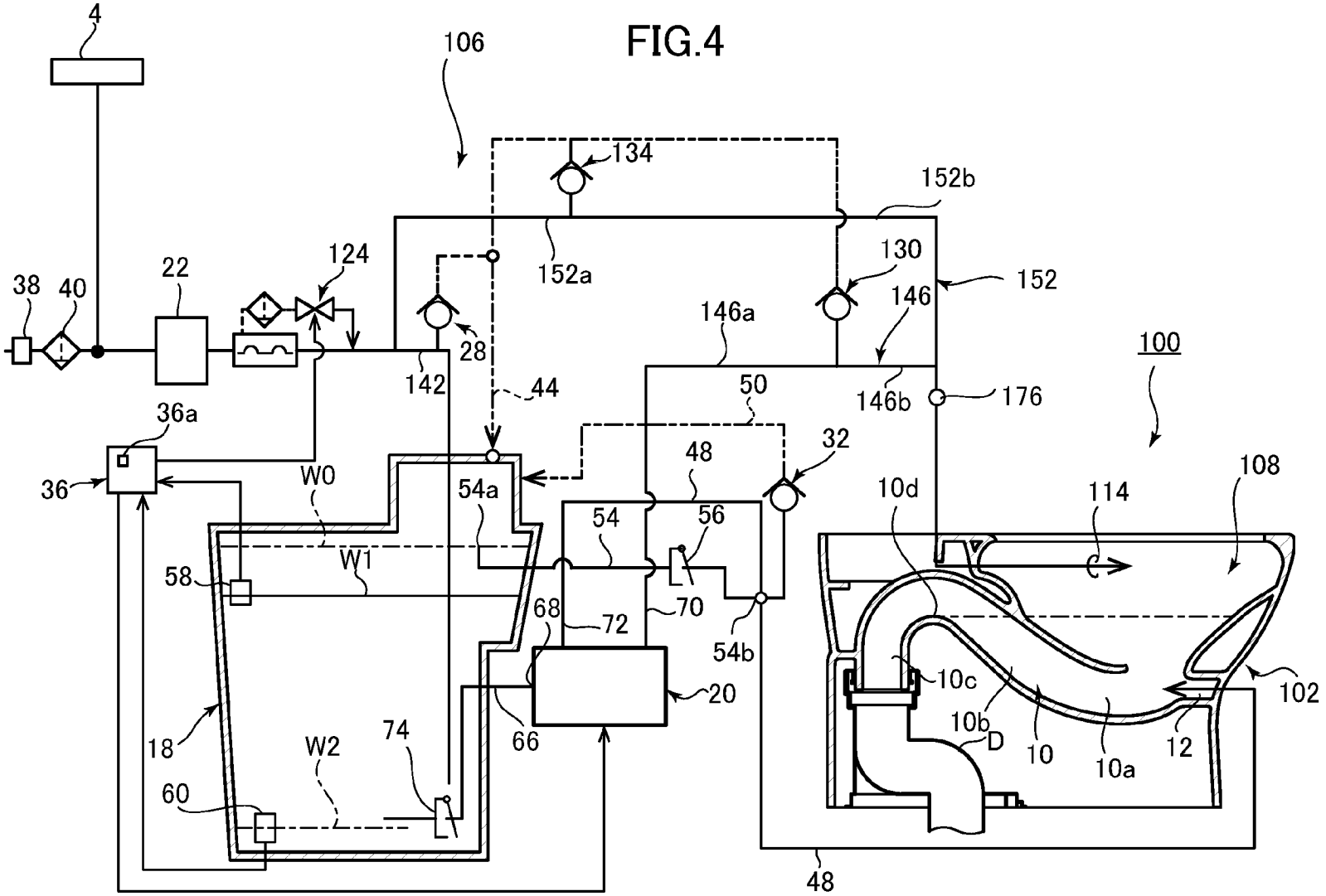
FIG. 4 is an overall schematic showing a flush toilet according to a second embodiment of the invention.
Figure 5:
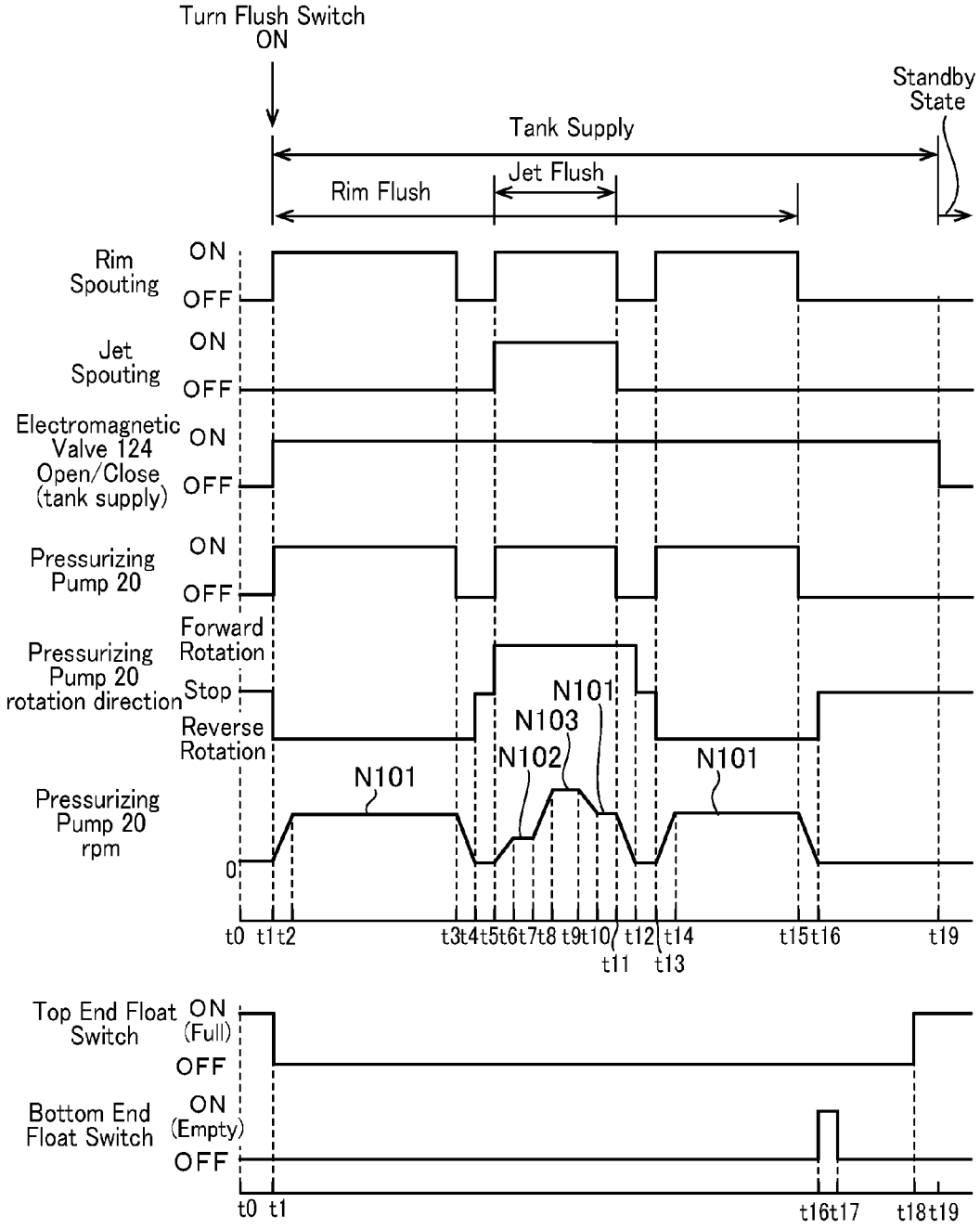
FIG. 5 is a flow chart showing the basic operations of a flush toilet according to the second embodiment of the invention.

Next, referring to FIGS. 4 and 5, we explain a flush toilet according to the second embodiment of the invention.

FIG. 4 is an overview diagram showing a flush toilet according to the second embodiment of the invention, and FIG. 5 is a timing chart showing a flush toilet according to the second embodiment of the invention.

Here, in a flush toilet 100 according to the second embodiment of the present invention shown in FIGS. 4 and 5, the same reference numerals are used for the same parts as the flush toilet 1 according the first embodiment of the invention, and an explanation thereof is omitted; only differing parts are explained.

First, as shown in FIG. 4, in contrast to the flush toilet 1 of the first embodiment, which includes two spout ports being first rim spout port 14 and second rim spout port 16, in the flush toilet 100 according to the second embodiment the structure in which a single rim spout port 114 on the toilet main unit 102 differs from the structure of the flush toilet 1 in the first embodiment.

Also, in contrast to the functional portion 6 structure of the flush toilet 1 of the first embodiment, which includes a storage tank water supply electromagnetic valve 24 disposed on the storage tank-side water supply conduit 42 leading from the fixed flow valve 22 to the storage tank 18, and two electromagnetic valves made up of the second rim spout electromagnetic valves 26 disposed on the second rim-side supply path 52 leading from the fixed flow valve 22 to the second rim spout port 16, in the flush toilet 100 according to the second embodiment the structure of the functional portion 106, in which a single electromagnetic valve 124 is disposed on the supply path 142 between the fixed flow valve 22 and the storage tank 18, differs from the flush toilet 1 of the first embodiment.

In addition, in contrast to the structure in the flush toilet 1 of the first embodiment, in which the first rim-side water supply path 46 leading to the first rim spout port 14 and the second rim-side supply path 52 leading to the second rim spout port 16 are respectively independently disposed, the structure of the flush toilet 100 of the second embodiment includes a rim-side water supply path 146 extending from the pressurizing pump 20 jet-side discharge portion 70 to the rim spout port 114 side, and a rim-side supply path 152 branching from the downstream side of the supply path 142 electromagnetic valve 124 and leading to the rim spout port 114 side, and these rim-side water supply paths 146 and 152 are directed to the rim spout port 114 after mutually merging on the downstream side, which differs from the structure of the first embodiment flush toilet 1.

In the flush toilet 100 according to the second embodiment of the invention, the rim-side water supply path 146 includes a first flow path 146*a* connecting the pressurizing pump 20 rim-side discharge portion 70 and the first vacuum breaker 130, and a second flow path 146*b* connecting the rim spout port 114 and the first vacuum breaker 130, while the rim-side supply path 152 includes a first flow path 152*a* connecting the electromagnetic valve 124 and a second vacuum breaker 134, and a second flow path 152*b* connecting the rim spout port 114 and the second vacuum breaker 134.

By means of the above, when water is spouted from the pressurizing pump 20 rim-side discharge portion 70 through the rim-side water supply path 146 to the rim spout port 114, the second vacuum breaker 134 can close the rim-side supply path 152 first flow path 152*a* so that water can be spouted from the rim-side water supply path 146 second flow path 146*b* to the bowl portion 8 by the rim spout port 114.

On the other hand when water is spouted from the electromagnetic valve 124 through the rim-side supply path 152 to the rim spout port 114, the first vacuum breaker 130 closes the rim-side water supply path 146 first flow path 146*a*, and water can be spouted from the rim-side supply path 152 second flow path 152*b* into the bowl portion 8 by the rim spout port 114.

Next, referring to FIGS. 4 and 5, we explain the operation (action) of a flush toilet 100 according to the above-described second embodiment of the invention.

First, as shown in FIG. 5, in the standby state (time t0 to t1), the water level of flush water in the storage tank 18 is at a predetermined upper limit water level W1 below the full water level W0 corresponding to the top end 54*a* of the overflow path 54, and because this water level W1 reaches the top end float switch 58, the top end float switch 58 is on.

Then at time t1, when a user operates a toilet switch (not shown), the controller 36 sends a signal to open the electromagnetic valve 124.

The pressurizing pump 20 is turned on by control from the controller 36, a first time spouting (front rim flush) by the rim spout port 114 is started, and following this up to time t3, the controller executes a first sequence.

The execution of this first sequence results in flush water inside the storage tank 18 being supplied through the pressurizing pump 20 to the rim-side water supply path 146, and a predetermined amount of flush water being spouted from the rim spout port 114.

Here the electromagnetic valve 124 is open from times t1 to t19, and flush water supplied from the water main flows into the fixed flow valve 22 through the stop cock 38 and the strainer 40.

In addition, when the water main supply pressure is high in the fixed flow valve 22, the flow rate of transiting flush water is limited to a predetermined flow rate; when the supply pressure is low, flush water passes through unhindered, without being flow-limited. Then, flush water which has flowed through the fixed flow valve 22 passes through the electromagnetic valve 124, flows through the supply path 142, passes through the storage tank supply vacuum breaker 28, and flows into the storage tank 18.

At the same time, a portion of the flush water which has passed through the fixed flow valve 22 passes through the electromagnetic valve 124, then branches and flows to the rim-side supply path 152, and is rim spouted from the rim spout port 114.

In addition, when the pressurizing pump 20 turns on at time t1, the impeller 64 rotates in the reverse direction and accelerates until the overflow path 54 rpm N reaches a predetermined rpm N101 at time t2.

The impeller 64 rotates in the reverse direction after time t2; at time t3 the pressurizing pump 20 turns off, and the impeller 64 decelerates. Thereafter the impeller 64 rpm N goes to 0 at time t4, and the pressurizing pump 20 substantially stops.

As a result of this rotation of the pressurizing pump 20 impeller 64 in the reverse direction from time t1 until t4, flush water in the storage tank 18 passes through the flush water conduit 66 and is suctioned from the pressurizing pump 20 suctioning portion 68 into the casing 62, then is pressure fed from the pressurizing pump 20 rim-side discharge portion 70 to the rim-side water supply path 146. Flush water merging from the rim-side water supply paths 146 and 152 is ejected as rim spout water (see FIG. 5) from the rim spout port 114 at an instantaneous flow rate Q101 [L/min] (e.g., Q101=10 L/min). Flush water spouted from the rim spout port 114 flows down as it circulates in the bowl portion 8, cleaning the inside wall surface of the bowl portion 8.

Note that the instantaneous flow rate Q101 of flush water in the rim-side water supply paths 146 and 152 is sensed by a flow rate sensor 176; this sensed signal is transmitted to the controller 36, and the pressurizing pump 20 is controlled so that the spouted water amount in the rim spout port 114 is a predetermined amount.

In addition, during the time the impeller 64 is rotating in the reverse direction (t1 to t4), flush water is supplied from the pressurizing pump 20 jet-side discharge portion 72 to the jet-side water supply path 48, therefore no jet spouting from the jet spout port 12 is performed (see FIG. 5).

Also, as shown in FIG. 5, after time t1 the water level inside the storage tank 18 falls below the position of the top end float switch 58 due to the activation of the pressurizing pump 20, so that the top end float switch 58 turns off. On the other hand, because the water level inside storage tank 18 is above a predetermined lower limit water level W2, the bottom end float switch 60 is in an off state.

Next, as shown in FIG. 5, at time t5 to t11 the controller 36 executes a second sequence whereby flush water in the storage tank 18 is respectively supplied through the pressurizing pump 20 to the rim-side water supply path 146 and the jet-side water supply path 48, and a flush (mid rim flush) is performed by the second time rim spouting in which a predetermined amount of flush water is ejected from the rim spout port 114, and flushing by jet spouting is performed by the ejection of a predetermined amount of flush water from the jet spout port 12.

Here rim spouting in the rim spout port 114 also includes rim spout water which passes through the electromagnetic valve 124, branches to the rim-side supply path 152, and is ejected from the rim spout port 114.

Specifically, the pressurizing pump 20 again turns on under control of the controller 36 at time t5; the pressurizing pump 20 impeller 64 rotates in the forward direction, and after the impeller 64 rpm N reaches rpm N102 at time t6, it rotates in the forward direction at a constant predetermined rpm N102 until time t7. Note that this predetermined rpm N102 is set to be smaller than a predetermined rpm N101 from time t2 until time t3.

At time t3 the pressurizing pump 20 turns off and the first sequence ends; at time t5 the pressurizing pump 20 again turns on, and the time until the second sequence starts (t5-t3) is the time lag (t5-t3) until the pressurizing pump 20 impeller 64 switches over from a reverse direction rotation to a forward direction rotation; this time lag (t5-t3) is set, for example, to 0.5 msec. During this interval, particularly at time t4, even if the impeller 64 is substantially stopped, flush water in the pressurizing pump 20 casing 62 flows in reverse from the flush water conduit 66 to the storage tank 18 due to the flapper valve 74 along the flush water conduit 66 between the storage tank 18 and the pressurizing pump 20; draining out of flush water in the pressurizing pump 20 casing 62 so that priming water inside the casing 62 is eliminated is thus prevented.

In addition, at times t7 to t8, the impeller 64 accelerates until the impeller 64 rpm N reaches the maximum predetermined rpm N103, greater than rpm N101 and, at time t8-t9, the impeller 64 rotates in the forward direction at a constant predetermined rpm N103.

At time t9 to t10, the impeller 64 decelerates from the maximum predetermined rpm N103 to the predetermined rpm N101; at time t10 to t11, the impeller 64 rotates in the forward direction at a predetermined rpm N101. Then at time t1 the pressurizing pump 20 turns off and the impeller 64 decelerates; thereafter at time t12 the impeller 64 rpm N goes to 0, and the pressurizing pump 20 substantially stops.

I.e., when a second rim spouting by the rim spout port 114 is started at time t5, and an initial jet spouting by the jet spout port 12 is started by these operations of the pressurizing pump 20 in the second sequence from time t5 to t11, flush water in the storage tank 18 is suctioned through the flush water conduit 66 from the pressurizing pump 20 suctioning portion 68 into the casing 62, then pressure fed respectively to the first rim-side water supply path 46 and the jet-side water supply path 48 from the pressurizing pump 20 rim-side discharge portion 70 and the jet-side discharge portion 72, respectively.

At the same time, a portion of the flush water which has passed through the fixed flow valve 22 also passes through the electromagnetic valve 124, then branches and flows to the rim-side supply path 152 and is rim spouted from the rim spout port 114.

I.e., after merging on the downstream side, flush water from the rim-side water supply paths 146 and 152, respectively, is ejected as rim spout water (see FIG. 5) from the rim spout port 114 at an instantaneous flow rate Q102 [L/min] (e.g., Q102=6 L/min). Flush water spouted from the rim spout port 114 flows down as it circulates in the bowl portion 8, cleaning the inside wall surface of the bowl portion 8.

Note that the instantaneous flow rate Q102 of flush water in the rim-side water supply paths 146 and 152 is sensed by a flow rate sensor 176; this sensed signal is transmitted to the controller 36, and the pressurizing pump 20 is controlled so that the spouted water amount in the rim spout port 114 is a predetermined amount.

At the same time, flush water in the jet-side water supply path 48 is spouted as jet spout water (see FIG. 3) from the jet spout port 12 at a predetermined instantaneous flow rate Q103 [L/min] (e.g., Q103=85 L/min), flowing into the discharge trap conduit 10 and filling the discharge trap conduit 10 so as to induce the siphon phenomenon. This siphon phenomenon results in pooled water and waste in the bowl portion 8 being suctioned into the discharge trap conduit 10 and discharged from the discharge pipe D.

Note that in the present embodiment we have explained an example of rim spouting from the rim spout port 114 in the second sequence from time t5 to t11, but as a variant example it is also possible to increase water conservation by implementing only jet spouting by the jet spout port 12, not performing any rim spouting by rim spout port 114 whatsoever in the second sequence from time t5 to t11.

Specifically, the pressurizing pump 20 again turns on under control of the controller 36 at time t13; the pressurizing pump 20 impeller 64 again rotates in the reverse direction, and after the impeller 64 rpm N reaches rpm N101 at time t14, it rotates in the reverse direction at a constant predetermined rpm N101 until time t15. The pressurizing pump 20 then turns off at time t15; the impeller 64 decelerates, and subsequently at time t16 the impeller 64 rpm N goes to 0; the pressurizing pump 20 substantially stops, after which the pressurizing pump 20 is maintained in a stopped state until the next second toilet flush is started.

Thus at time t13 to t15, a third sequence is executed by which flushing (rear rim flushing) by a third spouting of a predetermined amount of flush water supplied to the rim spout port 114 from the respective rim-side water supply paths 146 and 152 is carried out at a predetermined instantaneous flow rate Q104 [L/min] (e.g., Q104=6 L/min).

Next, the bottom end float switch 60 goes on when the rim spout flush (rear rim flush) at time t16 has completed, the third sequence has completed, and the water level inside the storage tank 18 drops below a lower level water level W2 at around time t16, but at this point the electromagnetic valve 124 continues to be open, and water continues to be supplied from the electromagnetic valve 124 to the storage tank 18, therefore the water level in the storage tank 18 rises more than the lower limit water level W2 at time t17, and the bottom end float switch 60 again turns off.

In addition, the continued opening of the electromagnetic valve 124 until time t19 causes the water level in the storage tank 18 to rise; when it reaches the upper limit water level W1 at time t18, the top end float switch 58 turns on.

At time t19, the electromagnetic valve 124 closes and the storage tank 18 reaches an essentially full state; at times t19 and later, the same state as the above-described standby state (time t0-t1) applies until the next second toilet flush is started.

Note that, as described above, the pressurizing pump 20 is a centrifugal pump different from a vacuum pump, and cannot perform the function of a pump without priming water in the casing 62, therefore when starting the next toilet flush a sufficient amount of flush water is stored in the storage tank 18, and activation is of course started after the interior of the pressurizing pump 20 casing 62 is in all cases filled with priming water or the like, and even when performing a restore operation after an emergency stopping of the pressurizing pump 20, activation in all cases occurs with the interior of the casing 62 filled with flush water.

According to the flush toilet 100 of the above-described second embodiment of the invention, the pressurizing pump 20 is a reversible rotation centrifugal pump capable of rotation in the forward direction and reverse direction, therefore when the impeller 64 is rotating in the reverse direction, flush water in the storage tank 18 is spouted to the rim-side discharge portion 70 of the pressurizing pump 20 so that water can be spouted from the toilet main unit 102 rim spout port 114 to execute a rim flush.

On the other hand when the impeller 64 is rotating in the forward direction, flush water in the storage tank 18 is spouted at both the pressurizing pump 20 rim-side discharge portion 70 and the jet-side discharge portion 72, and rim flushing and jet flushing by spouting water respectively at both the toilet main unit 102 rim spout port 114 and the jet spout port 12 can be accomplished.

Therefore even when the fluid pressure of flush water supplied to a toilet main unit 2 directly connected to a water main water supply source is in a low pressure range (e.g. less than 0.05 MPa), stable spouting can be performed by the pressurizing pump 20.

Also, because a reversible rotation centrifugal pump furnished with an impeller 64 capable of rotating in the forward and reverse directions is used as the pressurizing pump 20, rim spouting and jet spouting can be easily performed using spouting by the pressurizing pump 20 alone.

In addition, there is no need to use a device other than the pressurizing pump 20 for adjusting the flow rate of flush water supplied from the storage tank 18 to the rim spout port 114 and the jet spout port 12 of the toilet main unit 2, and because space requirements for such equipment other than the pressurizing pump 20 can be eliminated, the overall flush toilet 1 can be reduced in size.

According to the flush toilet 100 of the present embodiment, after execution of a first sequence in which the controller 36 controls the pressurizing pump 20 so that a predetermined amount of flush water is spouted from the storage tank 18 to the rim spout port 114, a second sequence is executed to control the pressurizing pump 20 so that a predetermined amount of flush water is spouted from the storage tank 18 to both the rim spout port 114 and the jet spout port 12, thus enabling rim spouting and jet spouting to be performed simultaneously, so that persistence of the siphon action in the toilet flush of toilet main unit 2 can be improved.

Moreover, according to the flush toilet 100 of the present embodiment, a first rim supply vacuum breaker 130 for preventing reverse flow of flush water from the rim spout port 114, and for preventing inflow of flush water spouted from the pressurizing pump 20 rim-side discharge portion 70 into anything other than the toilet main unit 102 rim spout port 114, is disposed midway along the rim-side water supply path 146 for guiding flush water which has passed from the storage tank 18 through the pressurizing pump 20 and into the rim spout port 114; in addition, a second vacuum breaker 134 for preventing the reverse flow of flush water from the rim spout port 114, and for preventing the inflow of flush water (direct pressure water main water) which has passed through the electromagnetic valve 124 into anything other than the toilet main unit 102 rim spout port 114, is disposed midway along the rim-side supply path 152 guiding flush water which has passed from the fixed flow valve 22 through the electromagnetic valve 124 into the rim spout port 114, therefore a condition in which the pressurizing pump 20 rim-side discharge portion 70 and the electromagnetic valve 124 directly communicate (known as "cross connection") can be prevented.

Hence the occurrence of wasted water resulting from the inflow of flush water spouted from the pressurizing pump 20 rim-side discharge portion 70 into anywhere other than the toilet main unit 2 rim spout port 114 can be constrained, and the occurrence of wasted water resulting from the inflow of flush water (direct pressure water main water) spouted from the electromagnetic valve 124 to the rim-side supply path 152 into anywhere other than the toilet main unit 102 rim spout port 114 can be constrained. The reverse flow and penetration of waste water to the pressurizing pump 20 rim-side discharge portion 70 and the electromagnetic valve 124, respectively, can be constrained.

Also, according to the flush toilet 100 of the present embodiment, the rim-side water supply path 146 includes a first flow path 146*a* connecting the pressurizing pump 20 rim-side discharge portion 70 and the first vacuum breaker 130, and a second flow path 146*b* connecting the rim spout port 114 and the first vacuum breaker 130; and the rim-side supply path 152 includes a first flow path 152*a* connecting the electromagnetic valve 124 and the second vacuum breaker 134, and a second flow path 152*b* connecting the rim spout port 114 and the second vacuum breaker 134, such that in cases in which water is spouted from the pressurizing pump 20 rim-side discharge portion 70 through the rim-side water supply path 146 to the rim spout port 114, the second vacuum breaker 134 closes the rim-side supply path 152 first flow path 152*a*, and water can be spouted from the rim-side water supply path 146 second flow path 146*b* into the bowl portion 8 from the rim spout port 114.

On the other hand when water is spouted from the electromagnetic valve 124 through the rim-side supply path 152 into the rim spout port 114, the first vacuum breaker 130 closes the rim-side water supply path 146 first flow path 146*a*, and water can be spouted from the rim-side supply path 152 second flow path 152*b* into the bowl portion 8 by the rim spout port 114.

Therefore a cross connection between the pressurizing pump 20 rim-side discharge portion 70 and the electromagnetic valve 124 can be easily prevented using a simple configuration.

Hence the occurrence of water waste whereby flush water spouted to the rim-side water supply path 146 from the pressurizing pump 20 rim-side discharge portion 70 flows into any portion other than the toilet main unit 102 first rim spout port 114 can be reliably constrained, and the occurrence of water waste whereby flush water spouted from the electromagnetic valve 124 to the rim-side supply path 152 flows into any portion other than the rim spout port 114 on the toilet main unit 102 can be reliably constrained. Moreover, reverse flow and penetration of waste water to the pressurizing pump 20 rim-side discharge portion 70 and the electromagnetic valve 124, respectively, can be reliably constrained.

Also, according to the flush toilet 100 of the present embodiment, a flow rate sensor 176 disposed between the pressurizing pump 20 and the rim spout port 114 can sense the flush water instantaneous flow rates Q101, Q102 spouted from the rim spout port 114, and since this signal sensed by the flow rate sensor 176 is sent to the controller 36 and the pressurizing pump 20 is controlled so that the amount of spout water at the rim spout port 114 is a predetermined amount, more accurate spout control can be performed by the controller 36 in response to the spout water amount from the storage tank 18 spouted at the rim spout port 114 of the toilet main unit 102 than by sensing the water level in the storage tank 18.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet comprising:

a toilet main unit including a bowl portion, a rim spout portion and a jet spout portion for spouting flush water, and a discharge trap conduit;

a storage tank for storing flush water;

a valve apparatus for spouting flush water supplied from a water supply source to the storage tank or the toilet main unit;

a pressurizing pump including a suction portion connected to the storage tank, a rim-side discharge portion connected to the rim spout portion, and a jet-side discharge portion connected to a jet spout portion; and a control device which executes a rim flush wherein flush water in the storage tank is spouted from the rim spout portion by controlling the pressurizing pump, and/or executes a jet flush wherein flush water is spouted from the jet spout portion by controlling the pressurizing pump;

wherein the pressurizing pump is a reversible rotation pump including a reversible rotary impeller, wherein when the impeller is rotating in one direction, flush water in the storage tank is spouted to the rim-side discharge portion, and when the impeller is rotating in the other direction, flush water in the storage tank is spouted to the jet-side discharge portion, or flush water in the storage tank is spouted to both the rim-side discharge portion and the jet-side discharge portion.

2. The flush toilet according to claim 1, wherein the control device controls the pressurizing pump so that in a first sequence a predetermined amount of flush water is spouted to the rim spout portion, then in a second sequence a predetermined amount of flush water is spouted to both the rim spout portion and the jet spout portion, and then in a third sequence a predetermined amount of flush water is spouted to the rim spout portion.

3. The flush toilet according to claim 2, wherein the valve apparatus includes a first valve apparatus for spouting flush water supplied from the water supply source to the storage tank, and a second valve apparatus for spouting flush water supplied from the water supply source to the rim spout portion such that flush water does not pass through the storage tank or the pressurizing pump.

4. The flush toilet according to claim 3, wherein the control device executes water spouting from the rim spout portion for a predetermined time by opening the second valve apparatus in the second sequence.

5. The flush toilet according to claim 3, further comprising an inflow prevention apparatus that prevents flush water spouted from the rim-side discharge portion of the pressurizing pump or from the second valve apparatus, from flowing into portions other than the rim spout portion.

6. The flush toilet according to claim 5, further comprising a first flow path connecting the rim-side discharge portion of the pressurizing pump and the inflow prevention apparatus, a second flow path connecting the second valve apparatus and the inflow prevention apparatus, and a third flow path connecting the rim spout port and the inflow prevention apparatus; wherein the inflow prevention apparatus closes the second flow path when flush water is spouted from the pressurizing pump rim-side discharge portion, and closes the first flow path when flush water is spouted from the second valve apparatus.

7. The flush toilet according to claim 3, wherein the rim spout portion includes a first rim spout portion connected to the rim-side discharge portion of the pressurizing pump, and a second rim spout portion connected to the second valve apparatus.

8. The flush toilet according to claim 3, further comprising a flush water amount measuring device for measuring the amount of flush water pressurized by the pressurizing pump and spouted from the storage tank to the toilet main unit; wherein the control device executes spouting of a predetermined amount of spout water from the rim spout portion by opening and closing the second valve apparatus based on the flush water amount measured by the spout water amount measuring device in the second sequence.

9. The flush toilet according to claim 8, wherein the spout water amount measuring device is a water level sensor disposed inside the storage tank for measuring the water level inside the storage tank.

10. The flush toilet according to claim 3, further comprising a flush water amount measuring device for measuring the amount of flush water pressurized by the pressurizing pump and spouted from the storage tank to the toilet main unit; wherein the control device executes spouting of a predetermined amount of spout water from the rim spout portion by opening the second valve apparatus based on the flush water amount measured by the spout water amount measuring device in the third sequence.

11. The flush toilet according to claim 10, wherein the spout water amount measuring device is a water level sensor disposed inside the storage tank for measuring the water level inside the storage tank.

12. The flush toilet according to claim 3, wherein the control device opens only one of the first valve apparatus or the second valve apparatus during the period from the first through the third sequence.

13. The flush toilet according to claim 1, wherein the control device controls the pressurizing pump and the valve apparatus so that in a first sequence a predetermined amount of flush water is spouted to the rim spout portion by controlling the pressurizing pump, then in a second sequence a predetermined amount of flush water is spouted to the jet spout portion by controlling the pressurizing pump, and then in a third sequence a predetermined amount of flush water is spouted to the rim spout portion by controlling the valve apparatus.

14. The flush toilet according to claim 1, further comprising a flow rate sensor disposed between the pressurizing pump and the rim spout portion, for measuring the instantaneous flow rate of flush water spouted from the rim spout portion.

* * * * *